US008664843B2

(12) United States Patent
Yamada et al.

(10) Patent No.: US 8,664,843 B2
(45) Date of Patent: Mar. 4, 2014

(54) SPARK PLUG

(75) Inventors: Yuichi Yamada, Aichi (JP); Hiroaki Kuki, Aichi (JP); Naomichi Miyashita, Aichi (JP); Jiro Kyuno, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/638,703

(22) PCT Filed: Mar. 28, 2011

(86) PCT No.: PCT/JP2011/001832

§ 371 (c)(1), (2), (4) Date: Oct. 1, 2012

(87) PCT Pub. No.: WO2011/125306

PCT Pub. Date: Oct. 13, 2011

(65) Prior Publication Data

US 2013/0015756 A1 Jan. 17, 2013

(30) Foreign Application Priority Data

Apr. 2, 2010 (JP) ..... 2010-085880

(51) Int. Cl.
*H01T 13/20* (2006.01)

(52) U.S. Cl.
USPC ..... 313/143; 313/144; 313/137

(58) Field of Classification Search
USPC ..... 313/118, 137, 143, 144
See application file for complete search history.

(56) References Cited

U.S. PATENT DOCUMENTS

| | | | | |
|---|---|---|---|---|
| 5,831,377 | A | 11/1998 | Matsubara et al. | 313/141 |
| 6,111,345 | A * | 8/2000 | Shibata et al. | 313/141 |
| 7,183,702 | B2 * | 2/2007 | Kanao et al. | 313/118 |
| 7,528,534 | B2 | 5/2009 | Kuki et al. | 313/143 |
| 8,294,347 | B2 | 10/2012 | Nakamura et al. | 313/144 |
| 2007/0126330 | A1 | 6/2007 | Kuki et al. | 313/143 |
| 2008/0054778 | A1 | 3/2008 | Kumagai et al. | 313/143 |
| 2011/0181168 | A1 | 7/2011 | Nakamura et al. | 313/144 |

FOREIGN PATENT DOCUMENTS

| | | | |
|---|---|---|---|
| JP | 61-39880 | 3/1986 | H01T 13/16 |
| JP | 9-283259 | 10/1997 | H01T 13/20 |
| JP | 10-73069 | 3/1998 | F02P 17/12 |

(Continued)

OTHER PUBLICATIONS

International Search Report for International Application No. PCT/JP2011/001832, Jun. 28, 2011.

(Continued)

*Primary Examiner* — Mary Ellen Bowman
(74) *Attorney, Agent, or Firm* — Kusner & Jaffe

(57) ABSTRACT

A spark plug having an insulator with improved breakage resistance. The spark plug has a cross-section that satisfies the following relationship: 0.6 mm<=L, where "A" represents a connection point between a support portion of the insulator and an insulator trunk portion formed at a front end side with respect to the support portion, where "B" represents a position closer to the outer circumference side among the positions of (a) an innermost position of a contact portion where the support portion and a packing are in contact with each other and (b) an intersection of the support portion and a virtual straight line that is parallel to an axial line of the spark plug and extends from an innermost circumferential end of a stepped portion of a metal shell, and where "L" represents a length of a path from point "A" to point "B" along a surface of the insulator.

5 Claims, 14 Drawing Sheets

(56) References Cited

FOREIGN PATENT DOCUMENTS

| | | | |
|---|---|---|---|
| JP | 2001-313148 | 11/2001 | ..... H01T 13/20 |
| JP | 2002-260917 | 9/2002 | ..... H01F 7/06 |
| JP | 2005-183177 | 7/2005 | ..... H01T 13/36 |
| JP | 2005-190762 | 7/2005 | ..... H01T 13/36 |
| JP | 2008-84841 | 4/2008 | ..... H01T 13/36 |
| WO | WO 2010/035717 | 4/2010 | ..... H01T 13/36 |

OTHER PUBLICATIONS

Notification of the First Office Action (dated Jun. 8, 2013) issued in connection with corresponding Chinese Patent Application No. 201180017831.4, with English translation.

* cited by examiner

M14 Type (Radius of Curvature R=0)

| Sample No. | Insulator trunk portion Dia.$\phi$ (mm) | Creeping distance L (mm) | Insulator Strength (kN) |
|---|---|---|---|
| 1 | 7.20 | 0.30 | 0.28 |
| 2 | 6.98 | 0.40 | 0.35 |
| 3 | 6.75 | 0.50 | 0.42 |
| 4 | 6.52 | 0.60 | 0.50 |
| 5 | 6.28 | 0.70 | 0.51 |
| 6 | 6.06 | 0.80 | 0.52 |
| 7 | 5.82 | 0.90 | 0.50 |
| 8 | 5.60 | 1.00 | 0.41 |
| 9 | 5.35 | 1.10 | 0.30 |

M12 Type (Radius of Curvature R=0)

| Sample No. | Insulator trunk portion Dia. $\phi$ (mm) | Creeping Distance L (mm) | Insulator Strength (kN) |
|---|---|---|---|
| 21 | 5.51 | 0.30 | 0.10 |
| 22 | 5.28 | 0.40 | 0.15 |
| 23 | 5.05 | 0.50 | 0.23 |
| 24 | 4.82 | 0.60 | 0.30 |
| 25 | 4.59 | 0.70 | 0.32 |
| 26 | 4.35 | 0.80 | 0.34 |
| 27 | 4.12 | 0.90 | 0.30 |
| 28 | 3.90 | 1.00 | 0.20 |
| 29 | 3.65 | 1.10 | 0.10 |

M14 type (Insulator trunk portion diameter $\phi$ = 7.4mm)

| Sample No. | Radius of Curvature R (mm) | Creeping Distance L (mm) | Insulator Strength (kN) | Insulator Strength with Radius of Curvature R=0 (kN) | Strength Improvement Rate (%) | Airtightness Judgement |
|---|---|---|---|---|---|---|
| 41 | 0.00 | 0.36 | 0.31 | 0.31 | 0% | ○ |
| 42 | 0.40 | 0.48 | 0.52 | 0.40 | 30% | ○ |
| 43 | 0.50 | 0.50 | 0.59 | 0.42 | 40% | ○ |
| 44 | 0.60 | 0.58 | 0.68 | 0.48 | 42% | ○ |
| 45 | 0.80 | 0.64 | 0.72 | 0.50 | 44% | ○ |
| 46 | 1.00 | 0.70 | 0.73 | 0.51 | 43% | ○ |
| 47 | 1.50 | 0.88 | 0.77 | 0.50 | 54% | ○ |
| 48 | 1.75 | 0.98 | 0.77 | 0.42 | 83% | △ |
| 49 | 2.00 | 1.06 | 0.77 | 0.38 | 103% | △ |

M12 type (Insulator trunk portion diameter $\phi$ =5.7mm)

| Sample No. | Radius of Curvature R (mm) | Creeping Distance L (mm) | Insulator Strength (kN) | Insulator Strength with Radius of Curvature R=0 (kN) | Strength Improvement Rate (%) | Airtightness Judgement |
|---|---|---|---|---|---|---|
| 61 | 0.00 | 0.36 | 0.14 | 0.14 | 0% | ○ |
| 62 | 0.40 | 0.48 | 0.24 | 0.21 | 14% | ○ |
| 63 | 0.50 | 0.50 | 0.29 | 0.23 | 26% | ○ |
| 64 | 0.60 | 0.58 | 0.36 | 0.28 | 29% | ○ |
| 65 | 0.80 | 0.64 | 0.42 | 0.31 | 35% | ○ |
| 66 | 1.00 | 0.70 | 0.44 | 0.32 | 38% | ○ |
| 67 | 1.50 | 0.88 | 0.46 | 0.31 | 48% | ○ |
| 68 | 1.75 | 0.98 | 0.47 | 0.22 | 114% | × |
| 69 | 2.00 | 1.06 | 0.48 | 0.15 | 220% | × |

M14 type (Insulator trunk portion diameter $\phi$=6.3mm, Radius of Curvature R=0)

| Sample No. | Contact Length L2 (mm) | Creeping Distance L (mm) | Radius Difference rd (mm) | Insulator Strength (kN) | Airtight-ness Judgement |
|---|---|---|---|---|---|
| 81 | 0.62 | 0.60 | 0.00 | 0.51 | ○ |
| 82 | 0.50 | 0.70 | 0.10 | 0.52 | ○ |
| 83 | 0.45 | 0.75 | 0.15 | 0.53 | ○ |
| 84 | 0.35 | 0.83 | 0.23 | 0.53 | ○ |
| 85 | 0.30 | 0.88 | 0.28 | 0.54 | ○ |
| 86 | 0.25 | 0.92 | 0.32 | 0.55 | △ |
| 87 | 0.20 | 0.96 | 0.36 | 0.55 | △ |

M12 type (Insulator trunk portion diameter $\phi$=4.6mm, Radius of Curvature R=0)

| Sample No. | Contact Length L2 (mm) | Creeping Distance L (mm) | Radius Difference rd (mm) | Insulator Strength (kN) | Airtight-ness Judgement |
|---|---|---|---|---|---|
| 101 | 0.62 | 0.60 | 0.00 | 0.32 | ○ |
| 102 | 0.50 | 0.70 | 0.10 | 0.34 | ○ |
| 103 | 0.45 | 0.75 | 0.15 | 0.35 | ○ |
| 104 | 0.35 | 0.83 | 0.23 | 0.36 | ○ |
| 105 | 0.30 | 0.88 | 0.28 | 0.36 | ○ |
| 106 | 0.25 | 0.92 | 0.32 | 0.37 | × |
| 107 | 0.20 | 0.96 | 0.36 | 0.37 | × |

SPARK PLUG

FIELD OF THE INVENTION

The present invention relates to a spark plug.

BACKGROUND OF THE INVENTION

Conventionally, it has been known to provide spark plugs with reduced size while having improved anti-fouling properties, such as a spark plug disclosed in Japanese Patent Application Laid-Open (kokai) No. 2002-260917 ("Patent Document 1"). This technique realizes a miniaturization of a spark plug as well as improving anti-fouling properties by way of reducing a clearance between a metal shell and an insulator located near a firing end of the spark plug.

In the thus-miniaturized spark plug, since the insulator also has a smaller diameter, improvement in breakage resistance thereof has been an issue. In particular, strength improvement has been required in a contact portion of a packing for securing airtightness and the insulator.

Such demand has been common not only with a spark plug having a small clearance between the metal shell and the insulator, but also with general spark plugs.

See also, Japanese Patent Application Laid-Open (kokai) No. 2005-183177 ("Patent Document 2").

SUMMARY OF THE INVENTION

Problem(s) to be Solved by the Invention

The present invention has been conceived to solve the above-described problem, and an object of the present invention is to provide a technique capable of improving breakage resistance of an insulator of a spark plug.

Means for Solving the Problem

To solve, at least partially, the above problem, the present invention can be embodied in the following modes or application examples.

Aspect 1

A spark plug including:

a rod-like center electrode; an insulator assuming a generally cylindrical form and having therein a bore extending in an axial direction, the insulator accommodating the center electrode in a front end of the bore;

a metal shell assuming a generally cylindrical form, accommodating and holding therein the insulator with a stepped portion formed on an inner circumference thereof for engaging with a support portion formed on an outer circumference of the insulator; and an annular packing fitted in an intervening manner between the support portion on the outer circumference of the insulator and the stepped portion on the inner circumference of the metal shell, wherein, in a cross-section including an axial line of the spark plug, the following relationship is satisfied:

$$0.6\ \text{mm} <= L,$$

where "A" represents a connection point between the support portion of the insulator and an insulator trunk portion formed at a front end side with respect to the support portion of the insulator, where "B" represents a position closer to the outer circumference side among positions of (a) an innermost position of a contact portion where the support portion of the insulator and the packing are in contact with each other and (b) an intersection of the support portion of the insulator and a virtual straight line that is parallel to the axial line and extends from an innermost circumferential end of the stepped portion of the metal shell, and where "L" represents a length of a path from the point "A" to the point "B" along a surface of the insulator.

According to Aspect 1, since the length of the path from the point "A" to the point "B" where stress concentrates in the insulator is extended greater than a predetermined value, breakage resistance of the insulator of the spark plug can be improved.

Aspect 2

The spark plug according to Aspect 1, wherein the support portion of the insulator includes a curving portion at a front end side thereof through which the support portion is connected to the insulator trunk portion, and the following relationship is satisfied:

$$0.6\ \text{mm} <= R <= 1.5\ \text{mm},$$

where "R" represents a radius of curvature of the curving portion.

According to Aspect 2, since the radius of curvature of the curving portion is in a predetermined range, deterioration in airtightness can be prevented, and improvement in strength of the insulator of the spark plug is attainable.

Aspect 3

The spark plug according to Aspect 1 or 2, wherein the point B1, which is located in the innermost position of the contact portion where the support portion of the insulator and the packing are in contact with each other, is positioned outward with respect to the virtual straight line, and the following relationship is satisfied:

$$0.3\ \text{mm} <= L2,$$

where, in the cross-section including the axial line, "L2" represents a length of one of two contact surfaces where the support portion of the insulator and the packing are in contact with each other.

According to Aspect 3, since the length of the contact surface is extended greater than a predetermined value while preventing deterioration in airtightness, improvement in strength of the insulator of the spark plug is attainable.

Aspect 4

The spark plug according to any one of Aspect 1 to 3, wherein the following relationship is satisfied:

$$r1 - r2 <= 0.5\ \text{mm},$$

where "r1" represents a radius of an inner circumference of a metal shell shelf positioned frontwards with respect to the stepped portion of the metal shell, and where "r2" represents a radius of an outer circumference of a portion that faces a front end of the metal shell shelf in the insulator trunk portion.

According to Aspect 4, since an intrusion of unburnt gas into a clearance between the metal shell shelf and the insulator trunk portion can be prevented, improvement in anti-fouling properties of the spark plug is attainable.

Aspect 5

The spark plug according to any one of Aspects 1 to 4, wherein the following relationship is satisfied:

$$L <= 0.9\ \text{mm}.$$

According to Aspect 5, it is possible to prevent deterioration in breakage resistance of the insulator due to its thin wall.

Aspect 6

The spark plug according to any one of Aspect 1 to 5, wherein a mounting threaded portion on the outer circumferential face of the metal shell for mounting the spark plug on a fitting member has a thread size of M12 or less.

According to Aspect 6, the breakage resistance of the insulator can be improved in the spark plug having the mounting threaded portion with M12 or less.

Notably, the present invention can be implemented in various modes. For example, the present invention can be implemented in the form of a method of manufacturing a spark plug, an apparatus for manufacturing a spark plug, or the like.

DETAILED DESCRIPTION OF THE INVENTION

An embodiment of the present invention will now be described in the following order.

A. First Embodiment
B. Second Embodiment
C. Third Embodiment
D. Experiment
  D1. Experiment on Creeping Distance "L"
  D2. Experiment on Radius R of Curvature
  D3. Experiment on Contact Length L2
E. Modifications

A. First Embodiment

Figure 1:
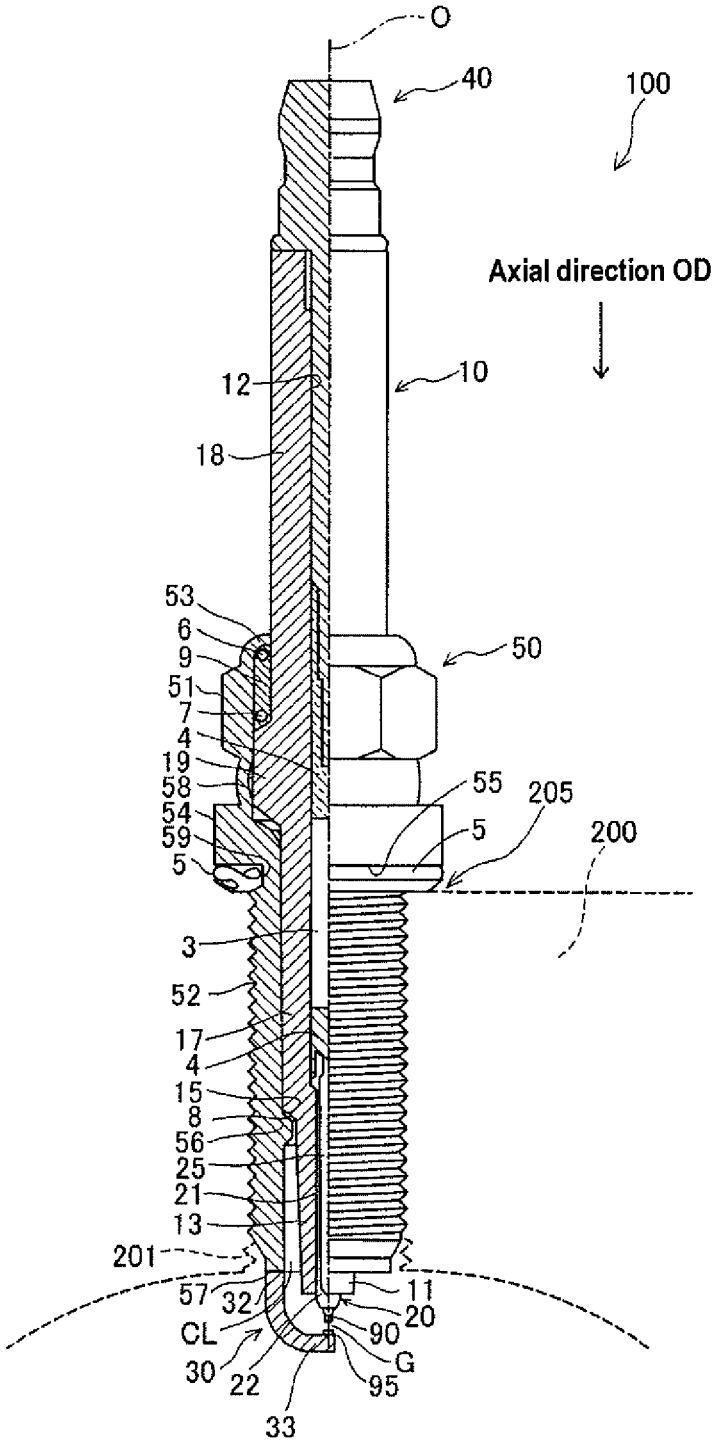
FIG. 1 is a partially sectional view of a spark plug 100 according to an embodiment of the present invention.

FIG. 1 is a partially sectional view of a spark plug 100 according to an embodiment of the present invention. In the following description, an axial direction OD of the spark plug 100 in FIG. 1 is referred to as the vertical direction, the lower side of the spark plug 100 in FIG. 1 is referred to as the front end side of the spark plug 100, and the upper side as the rear end side.

The spark plug 100 includes a ceramic insulator 10, a metal shell 50, a center electrode 20, a ground electrode 30, and a metal terminal 40. The center electrode 20 is held in the ceramic insulator 10 while extending in the axial direction OD. The ceramic insulator 10 serves as an insulator, and the metal shell 50 holds the ceramic insulator 10. The metal terminal 40 is mounted to the rear end portion of the ceramic insulator 10.

The ceramic insulator 10 is formed from alumina, etc. through firing and has a cylindrical tubular shape, and its axial bore 12 extends coaxially along the axial direction OD. The ceramic insulator 10 has a flange portion 19 having the largest outer diameter and located approximately at the center with respect to the axial direction OD and a rear trunk portion 18 located rearward (upward in FIG. 1) of the flange portion 19. The ceramic insulator 10 also has a front trunk portion 17 smaller in outer diameter than that of the rear trunk portion 18 and located frontward (downward in FIG. 1) of the flange portion 19, and a leg portion 13 smaller in outer diameter than that of the front trunk portion 17 and located frontward of the front trunk portion 17. The leg portion 13 is reduced in diameter in the frontward direction and is exposed to a combustion chamber of an internal combustion engine when the spark plug 100 is mounted to an engine head 200 of the engine. A support portion 15 is formed between the leg portion 13 and the front trunk portion 17.

The metal shell 50 is a cylindrical metallic member formed from low-carbon steel, and is adapted to fix the spark plug 100 to the engine head 200 of the internal combustion engine. The metal shell 50 holds the ceramic insulator 10 therein while surrounding the ceramic insulator 10 in a region extending from a portion of the rear trunk portion 18 to the leg portion 13.

The metal shell 50 has a tool engagement portion 51 and a mounting threaded portion 52. The tool engagement portion 51 allows a spark wrench (not shown) to be fitted thereto. The mounting threaded portion 52 of the metal shell 50 has a thread formed thereon, and is screwed into a mounting threaded hole 201 of the engine head 200 provided at an upper portion of the internal combustion engine. In addition, the size of the mounting threaded portion 52 is M12 in this embodiment.

The metal shell 50 has a flange-like seal portion 54 formed between the tool engagement portion 51 and the mounting threaded portion 52. An annular gasket 5 formed by folding a sheet is fitted to a screw neck 59 between the mounting threaded portion 52 and the seal portion 54. When the spark plug 100 is mounted to the engine head 200, the gasket 5 is crushed and deformed between a seat surface 55 of the seal portion 54 and a peripheral surface 205 around the opening of the mounting threaded hole 201. The deformation of the gasket 5 provides a seal between the spark plug 100 and the engine head 200, thereby preventing leakage of gas from the interior of the engine via the mounting threaded hole 201.

The metal shell 50 has a thin-walled crimp portion 53 located rearward of the tool engagement portion 51. The metal shell 50 also has a contractive deformation portion 58, which is thin-walled similar to the crimp portion 53, between the seal portion 54 and the tool engagement portion 51. Annular ring members 6, 7 intervene between an outer circumferential surface of the rear trunk portion 18 of the ceramic insulator 10 and an inner circumferential surface of the metal shell 50 extending from the tool engagement portion 51 to the crimp portion 53. Further, a space between the two ring members 6, 7 is filled with powder of talc 9. When the crimp portion 53 is crimped such that the crimp portion 53 is bent inward, the ceramic insulator 10 is pressed forward within the metal shell 50 via the ring members 6, 7 and the talc 9. As a result of the pressing, the support portion 15 of the ceramic insulator 10 is engaged with a stepped portion 56 formed on the inner circumference of the metal shell 50, whereby the metal shell 50 and the ceramic insulator 10 are united together. At this time, gas tightness between the metal shell 50 and the ceramic insulator 10 is maintained by an annular sheet packing 8 provided between the support portion 15 of the ceramic insulator 10 and the stepped portion 56 of the metal shell 50, whereby outflow of combustion gas is prevented. The sheet packing 8 is made of, for example, a material with high thermal conductivity, such as copper and aluminum. The sheet packing 8 with high thermal conductivity allows efficient heat conduction from the ceramic insulator 10 to the stepped portion 56 of the metal shell 50. Thus, the heat conduction of the spark plug 100 is enhanced, and the heat resistance thereof can be improved. The contractive deformation portion 58 is configured such that it deforms outward due to a compression force applied thereto during the crimping operation, thereby increasing the compression amount of the talc 9, whereby the gas tightness within the metal shell 50 is enhanced. Notably, a clearance CL of a predetermined dimension is provided between the ceramic insulator 10 and a portion of the metal shell 50 which extends frontward from the stepped portion 56 thereof.

The center electrode 20 is a rod-like electrode having a structure in which a core 25 is embedded within an electrode base member 21. The electrode base member 21 is formed of nickel (Ni) or an alloy, such as INCONEL (trademark) 600 or 601, which contains Ni as a predominant component. The core 25 is formed of copper (Cu) or an alloy which contains Cu as a predominant component, copper and the alloy being superior in thermal conductivity to the electrode base member 21. Usually, the center electrode 20 is fabricated as follows: the core 25 is placed within the electrode base member 21 which is formed into a closed-bottomed tubular shape, and the resultant assembly is drawn by extrusion from the bottom side. The core 25 is formed such that, while its trunk portion has a substantially constant outer diameter, its front end portion is tapered. The center electrode 20 disposed in an axial bore 12 of the ceramic insulator 10 extends toward the rear end side, and is electrically connected to the metal terminal 40 via a seal member 4 and a ceramic resistor 3. A high-voltage cable (not shown) is connected to the metal terminal 40 via a plug cap (not shown) so as to apply high voltage to the metal terminal 40.

The front end portion 22 of the center electrode 20 projects from the front end portion 11 of the ceramic insulator 10. A center electrode tip 90 is joined to the front end of the front end portion 22 of the center electrode 20. The center electrode tip 90 assumes the form of an approximate cylindrical column which extends in the axial direction OD. The center electrode tip 90 is made of noble metal having a high melting point in order to improve spark erosion resistance thereof.

The electrode tip 90 is formed of Ir, or an alloy containing Ir as a predominant component and one or more components selected from platinum (Pt), rhodium (Rh), ruthenium (Ru), palladium (Pd) and rherium (Re).

The ground electrode 30 is formed of a metal having high corrosion resistance; for example, a Ni alloy such as INCONEL (trademark) 600 or 601. A proximal end portion 32 of the ground electrode 30 is joined to a front end portion 57 of the metal shell 50 through welding. The ground electrode 30 is bent such that a distal end portion 33 of the ground electrode 30 faces the center electrode tip 90.

In addition, a ground electrode tip 95 is joined to the distal end portion 33 of the ground electrode 30. The ground electrode tip 95 faces the center electrode tip 90, and a spark discharge gap G is formed therebetween. The ground electrode tip 95 may be formed of the same material as that of the center electrode tip 90.

Figure 2:
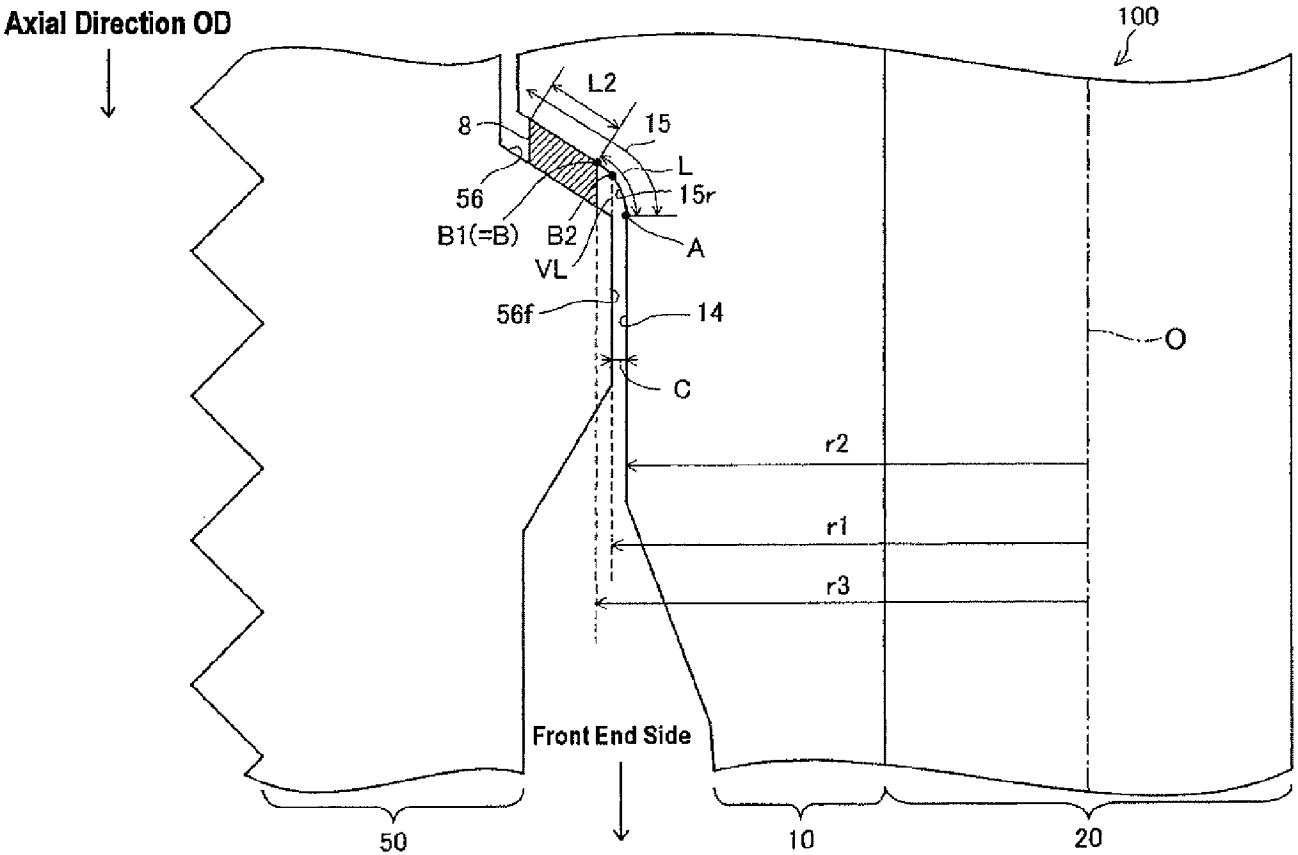
FIG. 2 is an enlarged view of a support portion 15 of a ceramic insulator 10 and its surrounding.

FIG. 2 is a cross-sectional view showing, on an enlarged scale, around the ceramic insulator 10 and the support portion 15. FIG. 2 shows the spark plug 100 sectioned by a face including the axial line O. The lower side in FIG. 2 is referred to as the front end side, and a direction perpendicular to the axial direction OD is referred to as a radial direction.

As described above, the support portion 15 of the ceramic insulator 10 is engaged with the stepped portion 56 formed on the inner circumference of the metal shell 50 so as to hold the ceramic insulator 10. The annular sheet packing 8 is fitted in an intervening manner between the support portion 15 of the ceramic insulator 10 and the stepped portion 56 of the metal shell 50.

A connection point between the support portion 15 of the ceramic insulator 10 and the insulator trunk portion 14 formed on the front end side with respect to the support portion 15 of the ceramic insulator 10 serves as a point "A". An innermost point in a portion where the support portion 15 of the ceramic insulator 10 and the sheet packing 8 are in contact with each other serves as a point "B1". An intersection between the support portion 15 of ceramic insulator 10 and a virtual straight line VL parallel to the axial line "O" and extending from an innermost circumferential end of the stepped portion 56 of the metal shell 50 serves as a point "B2". A position closer to the outer circumference side among the points B1 and B2 serves as a point "B". In FIG. 2, the point B1 is equal to the point "B". A length of a path from the point "A" to the point "B" along the surface of the ceramic insulator 10 serves as "L". In this case, the spark plug 100 preferably satisfies the following relationship (1):

$$0.6\ \text{mm} <= L \qquad (1).$$

The reasons are as follows. In addition, "L" is also referred to as "a creeping distance L".

The point "A" is the position where the support portion 15 of the ceramic insulator 10 and the insulator trunk portion 14 are in contact with each other and at which the ceramic insulator 10 deforms as a starting point. Thus, if any stress is applied to the ceramic insulator 10 in the radial direction, stress concentrates on the point "A". Since the point B1 is in the position where the support portion 15 and the sheet packing 8 are in contact with each other, compressive stress is generated on the point B1. When the point B2 is positioned outward with respect to the point B1—i.e., the inner circumference of the sheet packing 8 is positioned inward with respect to the virtual straight line VL, the point B2 receives compression stress from the metal shell shelf 56*f*. That is, the stress concentrates the most on the point "B" which is in the outward position with respect to the points B1 and B2 in the support portion 15.

When the creeping distance "L" is extended, i.e., the distance between the point "A" and the point "B" where stress concentrates is extended, an improvement in breakage resistance of the ceramic insulator 10 is possible because the stress concentration is avoidable. The reason for specifying the creeping distance "L" using the relationship (1) will be described later.

Further, the support portion 15 of the ceramic insulator 10 includes a curving portion 15*r* in the front end side thereof through which the support portion 15 is connected to the insulator trunk portion 14. The spark plug 100 preferably satisfies the following relationship (2), where "R" represents a radius of curvature of the curving portion 15*r*:

$$0.6\text{ mm} <= R <= 1.5\text{ mm} \quad (2)$$

The reasons are as follows. Since stress concentration on the point "A" can be prevented if the radius of curvature "R" of the curving portion 15*r* is made large, the strength of the ceramic insulator 10 can be improved. On the other hand, when the radius of curvature "R" of the curving portion 15*r* is made small, the airtightness between the sheet packing 8 and the ceramic insulator 10 can be improved. Thus, when the radius of curvature "R" of the curving portion 15*r* falls within a range of the relationship (2), improvement in breakage resistance of the ceramic insulator 10 is attainable while securing the airtightness between the sheet packing 8 and the ceramic insulator 10. The reasons for specifying the radius of curvature "R" to be in the range of relationship (2) will be described later.

As shown in the cross-sectional view of FIG. 2, in the case where the point B1 is positioned outward with respect to the virtual straight line VL, a length of one of two contact surfaces of the support portion 15 and the sheet packing 8 serves as "L2". In addition, although there is the other contact surface in a symmetrical position to the axial line O, it is not shown in FIG. 2. The spark plug 100 preferably satisfies the following relationship (3):

$$0.3\text{ mm} <= L2 \quad (3)$$

The reason for that is as follows. In addition, "L2" will also be referred to as a "contact length L2."

Since the contact area of the sheet packing 8 and the ceramic insulator 10 becomes large when the contact length. L2 is extended, the airtightness between the sheet packing 8 and the ceramic insulator 10 can be improved. Therefore, when the contact length L2 falls within the range of relationship (3), improvement in airtightness between the sheet packing 8 and the ceramic insulator 10 is attainable. The reasons for specifying the contact length L2 to be within the range of relationship (3) will be described later.

Furthermore, a radius of an inner circumference of the metal shell shelf 56*f* positioned frontward with respect to the stepped portion 56 of the metal shell 50 serves as "r1", and a radius of an outer circumference of the insulator trunk portion 14 serves as "r2". A difference between the radius r1 and the radius r2 serves as a clearance "C". The spark plug 100 preferably satisfies the following relationship (4):

$$C(=r1-r2) <= 0.5\text{ mm} \quad (4)$$

The reasons for that are as follows.

When a spark plug is used in a state that the electrode is at low temperature of 450 degrees C. or lower during, for example, predelivery, it generates a large amount of unburnt gas. If such unburnt gas exists for a long time, the ceramic insulator will be in a state called a "fouling" or "wet fouling". As a result, the ceramic insulator is covered with conductive contamination, such as carbon, and the spark plug tends to operate improperly. Particularly, when unburnt gas intrudes into the clearance between the metal shell shelf 56*f* and the insulator trunk portion 14, the surface of the ceramic insulator is fouled, which in turn causes spark discharge in the clearance, and normal ignition cannot be sustained. When the clearance "C" is 0.5 mm or less, it is possible to prevent the intrusion of unburnt gas. As a result, the surface of the ceramic insulator can be prevented from fouling while miniaturizing the spark plug 100.

Furthermore, the creeping distance "L" preferably satisfies the following relationship (5):

$$L <= 0.9\text{ mm} \quad (5)$$

The reasons for that are as follows.

The extension of the creeping distance "L" allows an improvement in strength of the ceramic insulator 10. However, the radius r2 of the outer circumference of the insulator trunk portion 14 becomes small as the creeping distance "L" is extended. As a result, the wall thickness of the ceramic insulator 10 becomes thin, and the strength of ceramic insulator 10 deteriorates. Therefore, when the creeping distance "L" is below a predetermined value, the radius r2 of the outer circumference of the insulator trunk portion 14 becomes greater than a predetermined value. This results in preventing the ceramic insulator 10 from deterioration in breakage resistance due to its thin wall. The reasons for specifying the creeping distance "L" to be in the range of the relationship (5) will be described later.

In the first embodiment, since the spark plug is constituted so as to satisfy the above-mentioned relationships, the breakage resistance of the ceramic insulator 10 can be improved. In addition, the spark plug 100 does not necessarily satisfy all the relationships mentioned above, but may satisfy any one or more of the relationships. However, if the spark plug 100 is constituted with satisfying all the relationships, improvement in breakage resistance of the ceramic insulator 10 can be more appropriately attained.

B. Second Embodiment

Figure 3:
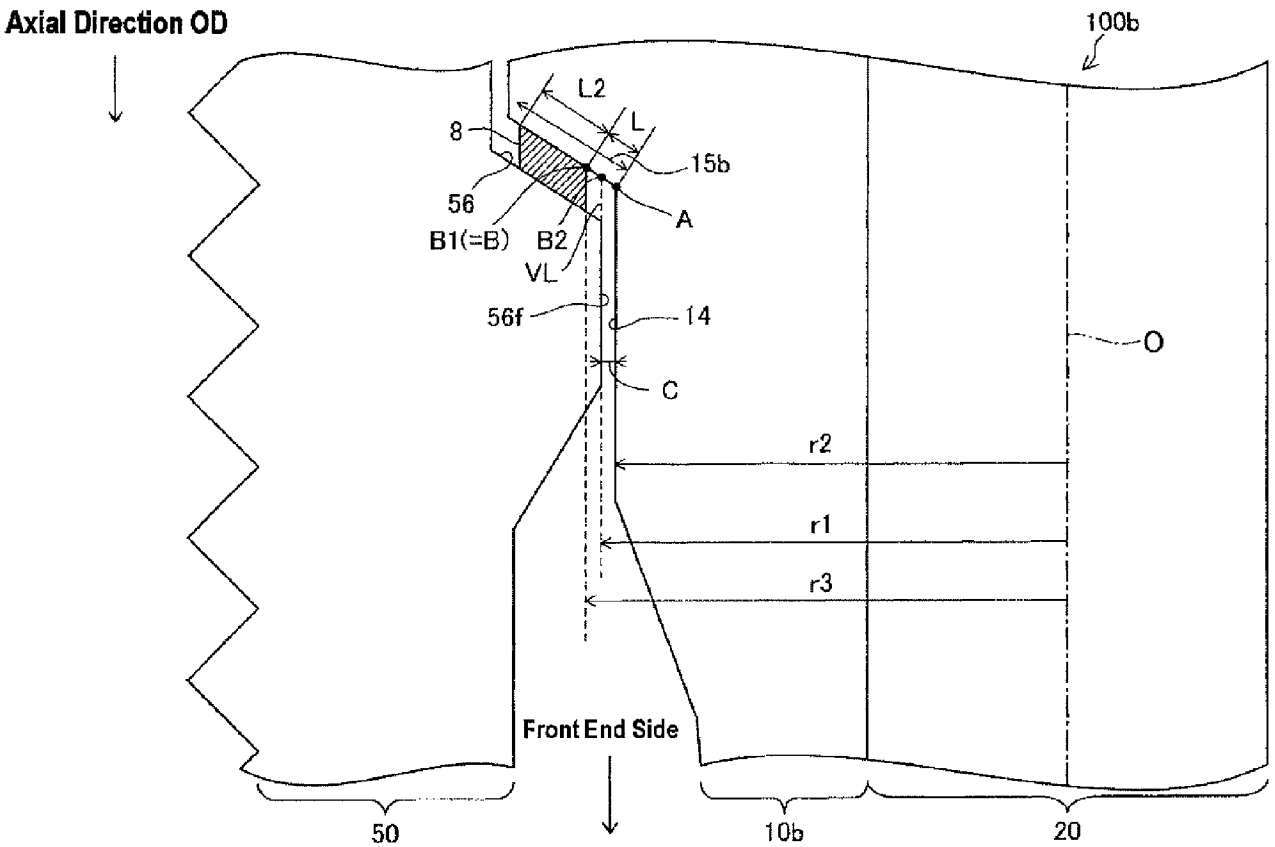
FIG. 3 is an enlarged view of a support portion 15*b* of a ceramic insulator 10*b* and its surrounding in a spark plug 100*b* according to a second embodiment.

FIG. 3 is an enlarged view of a support portion 15*b* of a ceramic insulator 10*b* of a spark plug 100*b* according to a second embodiment. Difference to the first embodiment shown in FIG. 2 is only the shape of the ceramic insulator 10*b*. Other composition of spark plug 100*b* is the same as that of the first embodiment. The ceramic insulator 10*b* does not have the curving portion 15*r* at the front end side of the support portion 15*b*, and the support portion 15*b* is formed linearly. When the spark plug 100*b* without the curving portion 15*r* satisfies the relationship (2), improvement in breakage resistance of the ceramic insulator 10*b* is attainable.

C. Third Embodiment

Figure 4:
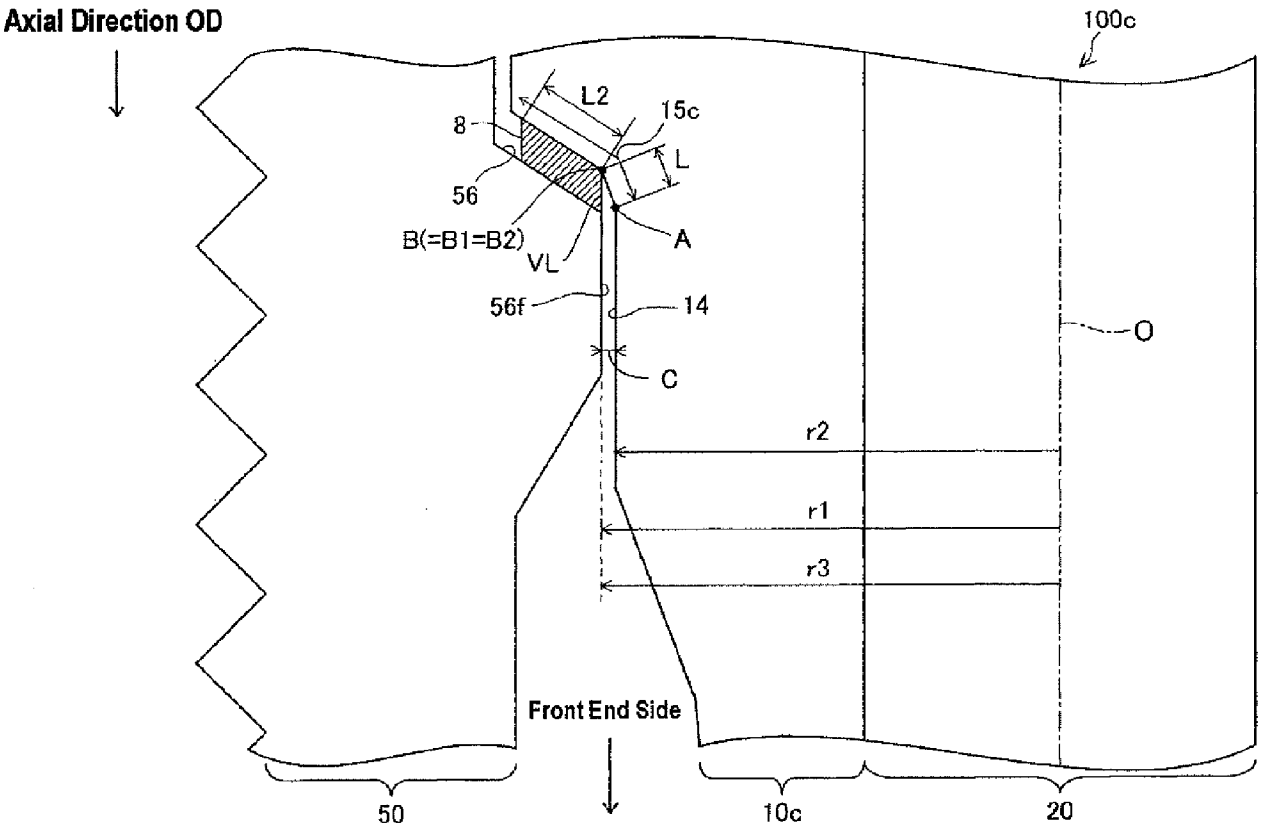
FIG. 4 is an enlarged view of a support portion 15*c* of a ceramic insulator 10*c* and its surrounding in a spark plug 100*c* according to a third embodiment.

FIG. 4 is an enlarged view of a support portion 15*c* of a ceramic insulator 10*c* and its surrounding in a spark plug 100*c* according to a third embodiment. Difference to the first embodiment shown in FIG. 2 is shapes of the ceramic insulator 10*c* and the sheet packing 8. Other composition of the spark plug 100*c* is the same as that of the first embodiment. The ceramic insulator 10*c* does not include the curving portion 15*r* at the front end side of the support portion 15*c*. Frontward of the support portion 15*c* with respect to the point B1 is bent. Further, a radius r3 of the inner circumference of the sheet packing 8 is equal to the radius r1 of the inner circumference of metal shell shelf 56*f*. Thus, the point "B" serves as a point where the point B1 matches with the point B2. When the spark plug 100*c* without the curving portion 15*r* satisfies the relationship (2), improvement in breakage resistance of the ceramic insulator 10*c* is attainable.

D. Experiment

D1. Experiment on Creeping Distance "L"

In order to investigate the relationship between the strength of ceramic insulator and the creeping distance "L", a strength test was conducted using a plurality of samples which differ in the creeping distance "L". In the samples used in this test, the creeping distance "L" varied through changing the diameter ϕ of the insulator trunk portion 14 (=radius r2×2). In the strength test, a certain load was applied in the radial direction to a portion of the ceramic insulator which is 1.5 mm from the front end of the ceramic insulator so as to measure the load when the ceramic insulator is broken. In addition, two types of spark plugs, one of which was M14 (ISO metric screw thread) and the other was M12, were employed for the test. This applies to all other tests discussed below.

Figures 5, 6:
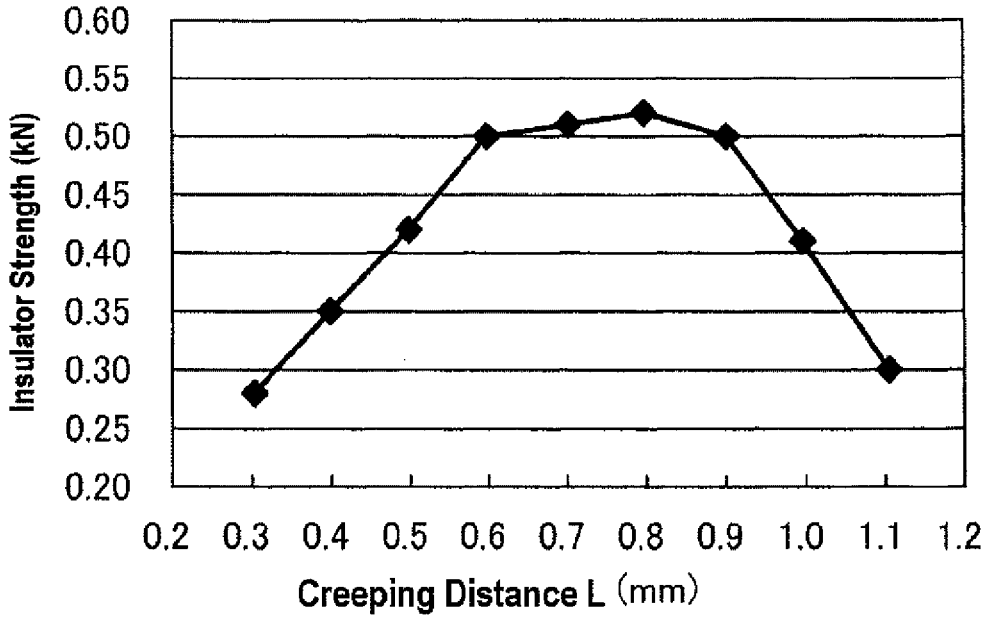
FIG. 5 is an explanatory view showing, in a table form, a result of a strength test of the ceramic insulator.
FIG. 6 is a graph showing a relationship between a creeping distance "L" and strength of the ceramic insulator.

FIG. 5 is an explanatory view showing, in a table form, the result of strength test of the ceramic insulator. FIG. 6 is a graph showing a relationship between the creeping distance "L" (mm) and strength (kN) of the ceramic insulator. The spark plugs used in FIGS. 5 and 6 were M14 type with the radius of curvature R=0.

According to FIGS. 5 and 6, the extension of the creeping distance "L" allows improvement in strength of the ceramic insulator. More particularly, the creeping distance "L" is preferably 0.5 mm or more, more preferably 0.6 mm or more, still more preferably 0.7 mm or more.

On the other hand, when the creeping distance "L" exceeds a predetermined value, the strength of the ceramic insulator deteriorates. Thus, when the creeping distance "L" is less than the predetermined value, deterioration in strength of the ceramic insulator can be prevented. More particularly, the creeping distance "L" is preferably 1.0 mm or less, more preferably 0.9 mm or less, still more preferably 0.8 mm or less.

Figures 7, 8:
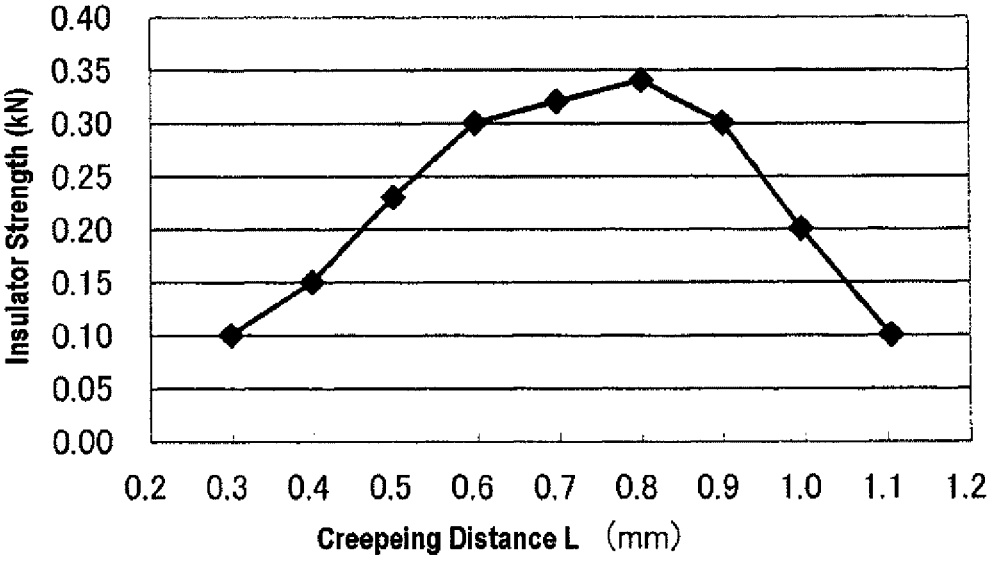
FIG. 7 is an explanatory view showing, in a table form, a result of the strength test of the ceramic insulator.
FIG. 8 is a graph showing a relationship between a creeping distance "L" and strength of the ceramic insulator.

FIG. 7 is an explanatory view showing, in a table form, a result of the strength test of the ceramic insulator. FIG. 8 is a graph showing a relationship between the creeping distance "L" (mm) and the strength (kN) of the ceramic insulator. The spark plugs used in FIGS. 7 and 8 were M12 type with the radius of curvature R=0.

According to FIGS. 7 and 8, the creeping distance "L" is preferably 0.5 mm or more, more preferably 0.6 mm or more, still more preferably 0.7 mm or more.

On the other hand, in order to prevent the deterioration in strength of ceramic insulator, the creeping distance "L" is preferably 1.0 mm or less, more preferably 0.9 mm or less, still more preferably 0.8 mm or less.

D2. Experiment on Radius of Curvature R

In order to investigate a relationship between the strength of ceramic insulator and the radius of curvature R of the curving portion 15*r*, the strength test was conducted using a plurality of samples which differ in radius of curvature R. Further, using these samples, an airtightness test which judges as to whether or not the airtightness between the sheet packing 8 and the ceramic insulator 10 was secured was conducted.

A method of strength test is the same as the above-described test, In order to investigate an extent of improvement in strength of the ceramic insulator of each sample over a sample having the radius of curvature R=0, a strength test was conducted also to the samples which differ in the radius of curvature "R" but have the same creeping distance "L" to thereby measure the improvement in strength of the ceramic insulator.

The airtightness test was conducted based on ISO standard (ISO 11565 sec.3.5:200 degrees C. under 2 MPa environment), and repeated for 5 times. The airtightness inside a cylinder was measured to evaluate the samples whose leakage was less than 1 mL/min was represented as excellent "○", and the samples whose leakage was 1 mL/min or more was represented as acceptable "Δ".

Figures 9, 10:
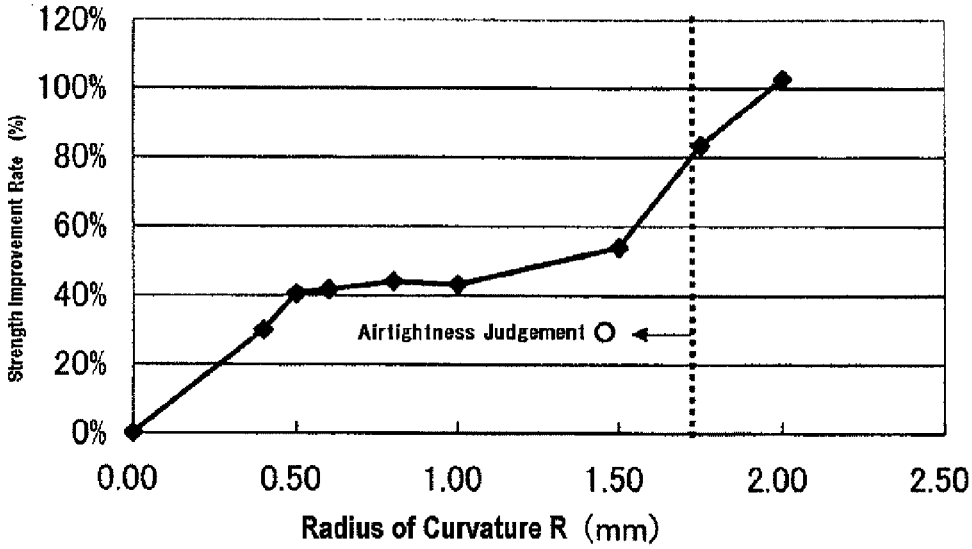
FIG. 9 is an explanatory view showing, in a table form, results of the strength test of the ceramic insulator and an airtightness judgment test.
FIG. 10 is a graph showing a relationship between radius of curvature R and a strength improvement rate of the ceramic insulator.

FIG. 9 is an explanatory view showing, in a table form, results of the strength test of the ceramic insulator and the airtightness judgment test. FIG. 10 is a graph showing a relationship between radius of curvature R (mm) and a strength improvement rate (%) of the ceramic insulator. The spark plugs used in FIGS. 9 and 10 were M14 type and having the diameter ϕ (=radius r2×2)=7.4 mm of the insulator trunk portion 14. In addition to the result of the test, FIG. 9 also shows the strength improvement rate (%) that indicates the extent of improvement in strength of the ceramic insulator of each sample over a sample with the radius of curvature R=0.

According to FIGS. 9 and 10, when the radius of curvature R is made large, it is apparent that the strength of the ceramic insulator improves. More particularly, the radius of curvature R is preferably 0.5 mm or more, more preferably 0.6 mm or more, still more preferably 1.0 mm or more.

On the other hand, when the radius of curvature R is not greater than a predetermined value, deterioration in airtightness can be prevented. More particularly, the radius of curvature R is preferably less than 1.75 mm, more preferably 1.50 mm or less.

Figures 11, 12:
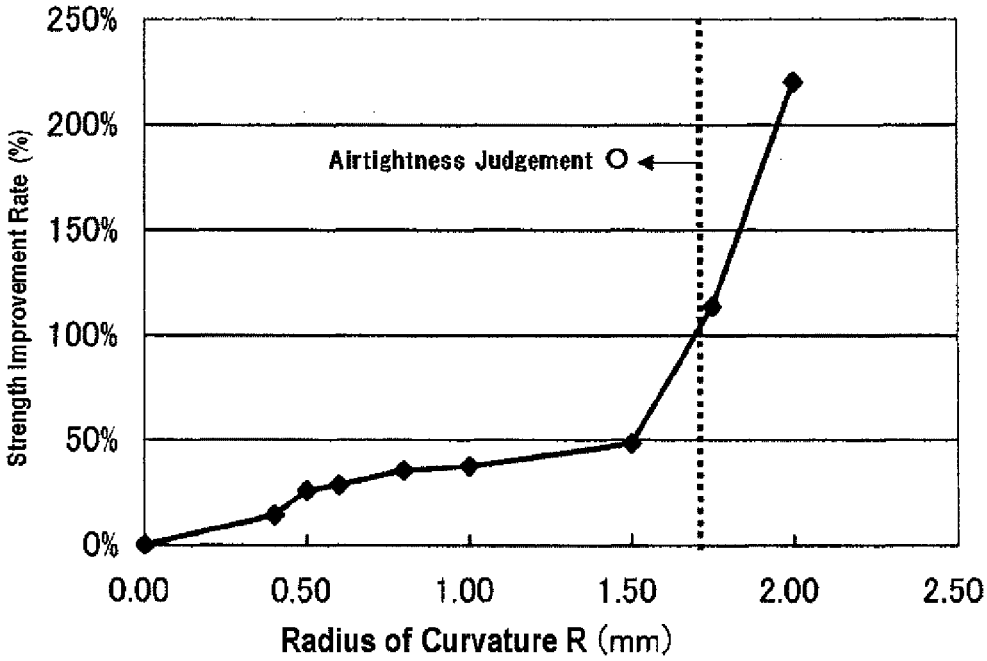
FIG. 11 is an explanatory view showing, in a table form, results of the strength test of the ceramic insulator and an airtightness judgment test.
FIG. 12 is a graph showing a relationship between radius of curvature R and a strength improvement rate of the ceramic insulator.

FIG. 11 is an explanatory view showing, in a table form, results of the strength test of the ceramic insulator and the airtightness judgment test. FIG. 12 is a graph showing a relationship between the radius of curvature R (mm) and the strength improvement rate (%) of the ceramic insulator. The spark plugs used in FIGS. 11 and 12 were M12 type and had the diameter ϕ(=radius r2×2)=5.7 mm of the insulator trunk portion 14.

According to FIGS. 11 and 12, in terms of the strength of the ceramic insulator, the radius of curvature R is preferably 0.5 mm or more, more preferably 0.6 mm or more, still more preferably 1.0 mm or more.

On the other hand, in terms of the airtightness, the radius of curvature R is preferably less than 1.75 mm, more preferably 1.50 mm or less.

D3. Experiment on Contact Length L2

In order to investigate a relationship between the strength of the ceramic insulator and the contact length L2, the strength test was conducted using a plurality of samples which differ in the contact length L2. Further, using these samples, an airtightness test was conducted to judge whether or not the airtightness between the sheet packing 8 and the ceramic insulator 10 was secured. The methods of strength test and airtightness test were the same as the aforementioned tests.

Figures 13, 14:
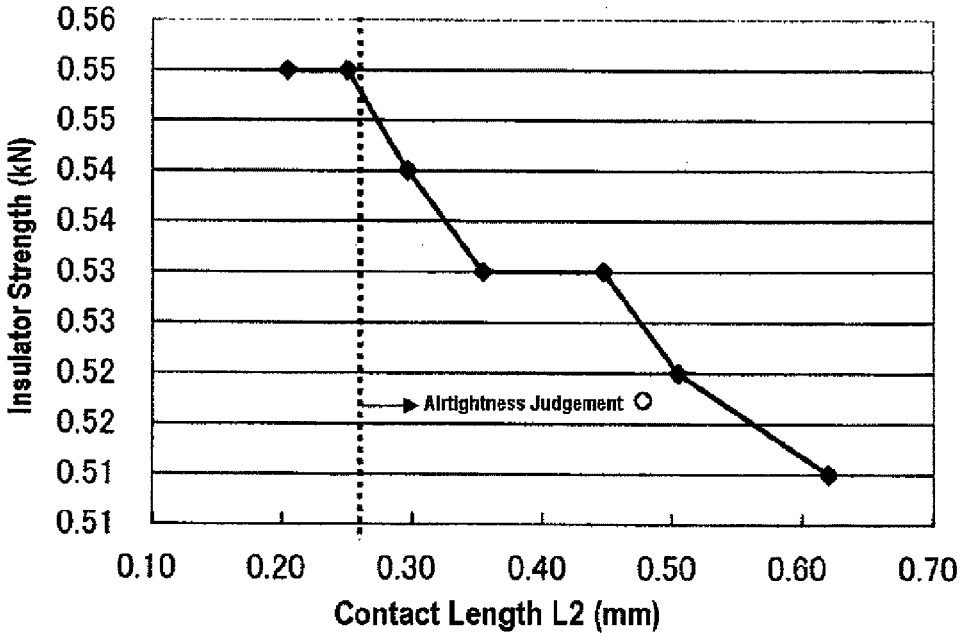
FIG. 13 is an explanatory view showing, in a table form, results of the strength test of the ceramic insulator and an airtightness judgment test.
FIG. 14 is a graph showing a relationship between a contact length L2 and the strength of the ceramic insulator.

FIG. 13 is an explanatory view showing, in a table form, the results of the strength test of the ceramic insulator and the airtightness judgment test. FIG. 14 is a graph showing a relationship between the contact length L2 (mm) and the strength (kN) of the ceramic insulator. The spark plugs used in FIGS. 13 and 14 were M14 type with radius of curvature R=0, and had the diameter ϕ (=radius r2×2)=6.3 mm of the insulator trunk portion 14. FIG. 13 also shows the creeping distance "L" and a radial difference "rd" (=r3−r1) (mm) of each sample. The radial difference "rd" means a difference between the radius "r3" of the inner circumference of the sheet packing 8 and the radius "r1" of the inner circumference of the metal shell shelf 56*f*.

According to FIGS. 13 and 14, when the contact length L2 is reduced, the airtightness deteriorates. Thus, when the contact length L2 is greater than a predetermined value, the deterioration in airtightness can be prevented. More particularly, the contact length L2 is preferably greater than 0.25 mm, more preferably 0.30 mm or more. Further, the radial difference rd is preferably less than 0.32 mm, and more preferably 0.28 mm or less.

On the other hand, since the creeping distance "L" is extended when the contact length L2 is reduced, improvement in strength of the ceramic insulator is attained. More particularly, the contact length L2 is preferably 0.50 mm or less, more preferably 0.45 mm or less, still more preferably 0.35 mm or less. Further, the radial difference rd is preferably 0.10 mm or more, more preferably 0.15 mm or more, still more preferably 0.23 mm or more.

Figures 15, 16:
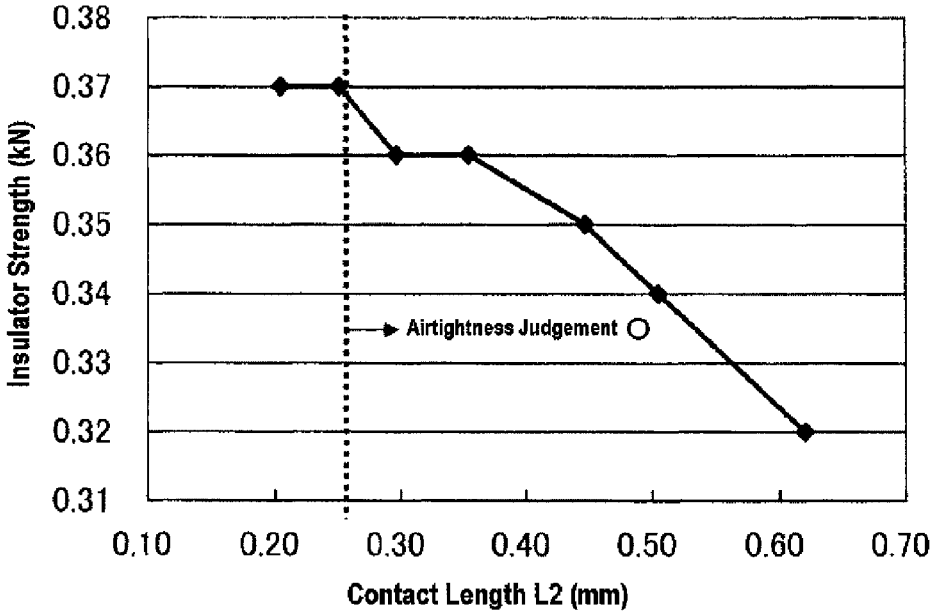
FIG. 15 is an explanatory view showing, in a table form, the results of the strength test of the ceramic insulator and the airtightness judgment test.
FIG. 16 is a graph showing a relationship between a contact length L2 and the strength of the ceramic insulator.

FIG. 15 is an explanatory view showing, in a table form, the results of the strength test of the ceramic insulator and the airtightness judgment test. FIG. 16 is a graph showing a relationship between the contact length L2 (mm) and the strength (kN) of the ceramic insulator. The spark plugs used in FIGS. 15 and 16 were M12 type with radius of curvature R=0, and had the diameter ϕ (=radius r2×2)=4.6 mm of the insulator trunk portion 14

According to FIGS. 15 and 16, in terms of the airtightness, the contact length L2 is preferably greater than 0.25 mm, more preferably 0.30 mm or more. Further, the radial difference rd is preferably less than 0.32 mm, more preferably 0.28 mm or less.

On the other hand, in terms of the strength of the ceramic insulator, the contact length L2 is preferably 0.50 mm or less, more preferably 0.45 mm or less, still more preferably 0.35 mm or less. Moreover, the radial difference rd is preferably 0.10 mm or more, more preferably 0.15 mm or more, still more preferably 0.23 mm or more.

E. Modification

The present invention is not limited to the above-described example and embodiment, and may be practiced in various forms without departing from the scope of the invention. For example, the following modifications are possible.

Figure 17:
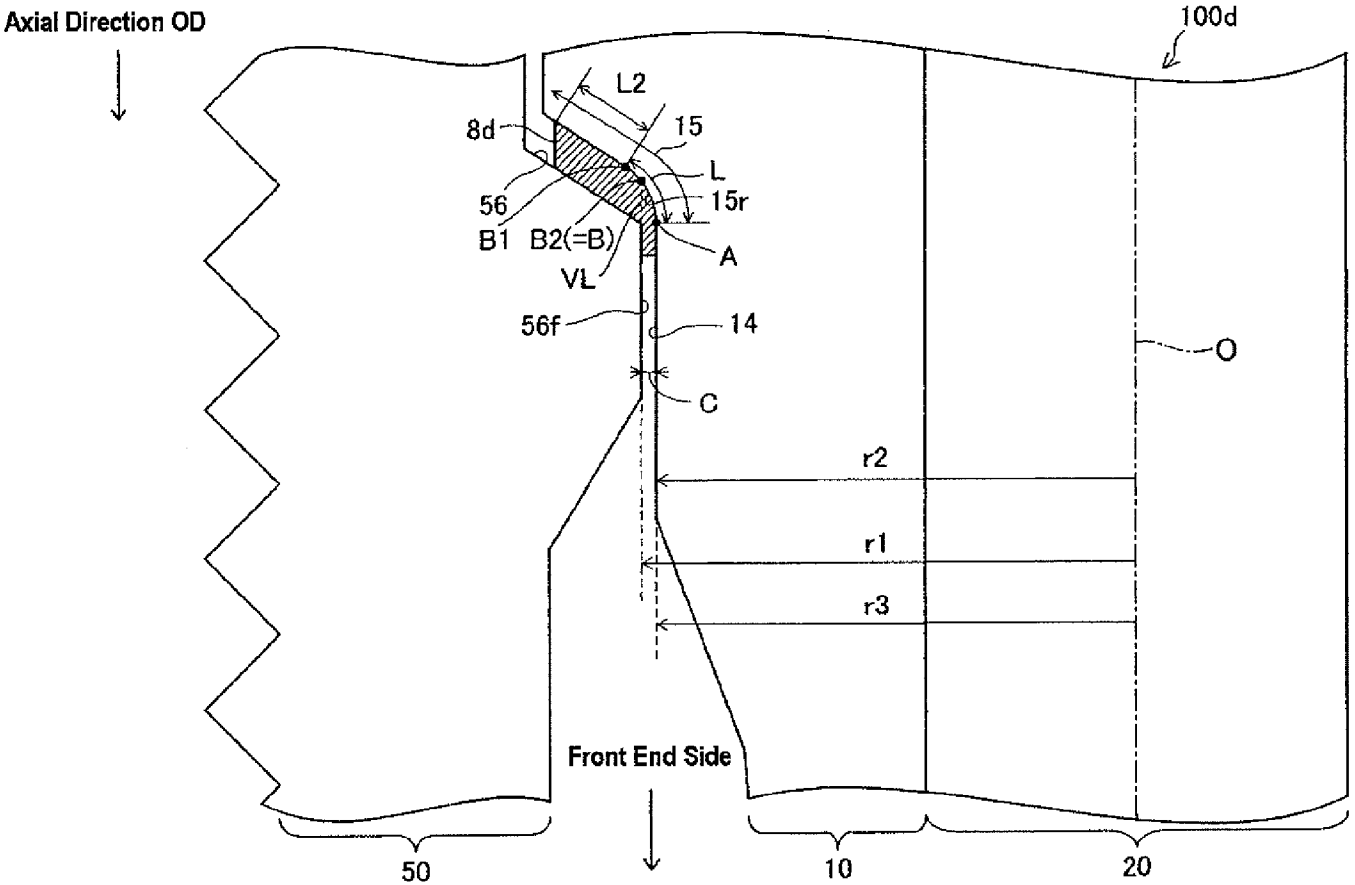
FIG. 17 is an enlarged view of a support portion 15 of a ceramic insulator 10 and its surrounding in a spark plug 100*d* according to a modification.

FIG. 17 is an enlarged view of the support portion 15 of the ceramic insulator 10 and its surrounding in a spark plug 100*d* according to a modification. The shapes of the ceramic insulator 10 and the metal shell 50 of the spark plug 100*d* shown in FIG. 17 are the same as those in the embodiment shown in FIG. 2. The difference is only a sheet packing 8*d*. In the embodiments shown in FIGS. 2 and 3, although the radius r3 of the inner circumference of the sheet packing 8 is larger than the radius r1 of the inner circumference of the metal shell shelf 56*f*, the radius r3 of the inner circumference of the sheet packing 8*d* may be smaller than the radius r1 as shown in FIG. 17. When the radius r3 is smaller than the radius r1, the creeping distance "L" is defined with the point B2 treated as the point "B".

Figure 18:
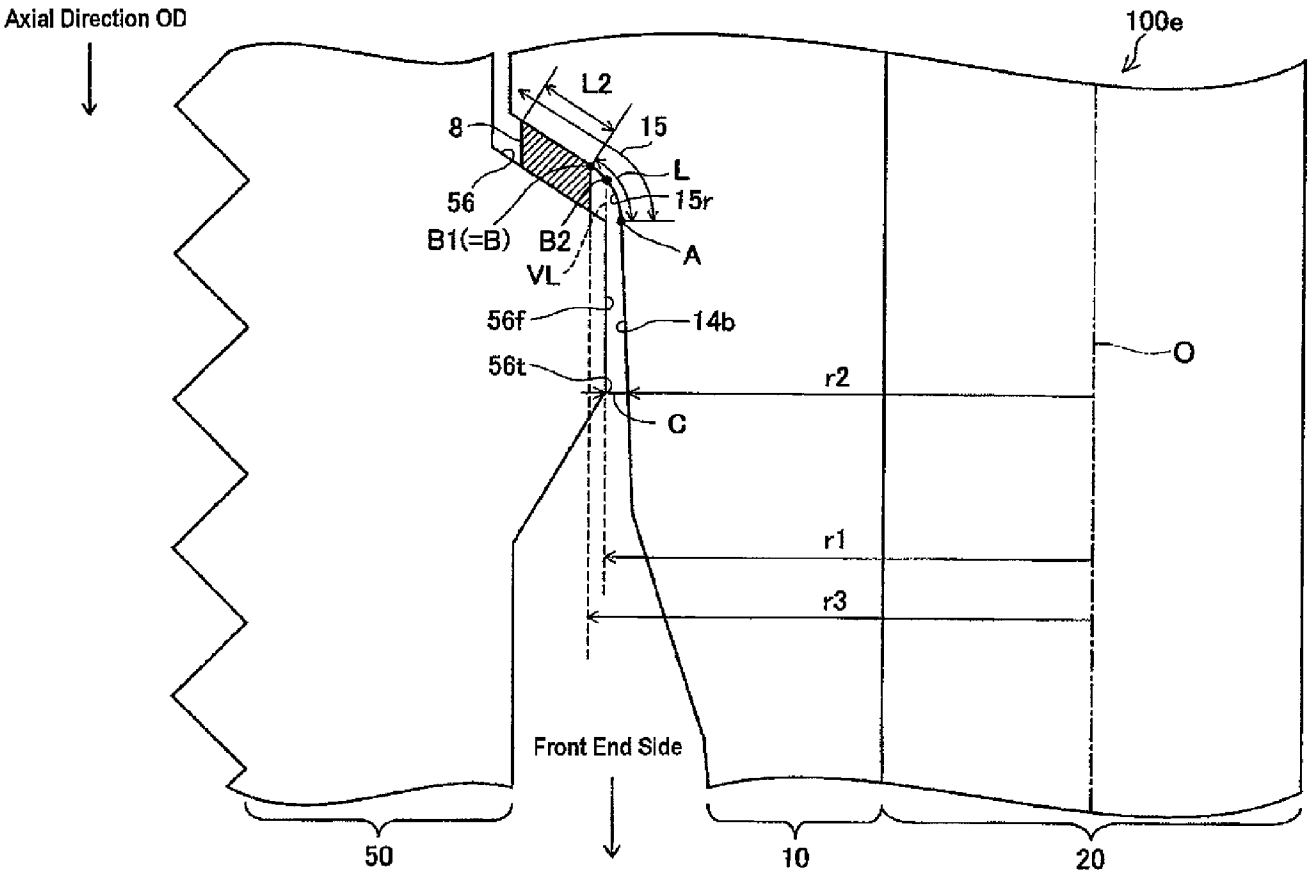
FIG. 18 is an enlarged view of a support portion 15 of a ceramic insulator 10 and its surrounding in a spark plug 100*e* according to a modification

FIG. 18 is an enlarged view of the support portion 15 of the ceramic insulator 10 and its surrounding in a spark plug 100*e* according to a modification. The difference with respect to the first embodiment shown in FIG. 2 is that the outer circumference of the insulator trunk portion 14*b* is tapered towards the front end side. Other composition of spark plug 100*e* is the same as that of the first embodiment. As shown in FIG. 18, when the outer circumference of the insulator trunk portion 14*b* is tapered towards the front end, the clearance C is so calculated that the radius of the outer circumference of a portion which faces a front end 56*t* of the metal shell shelf 56*f* serves as "r2" in the insulator trunk portions 14*b*. In this case, similar to the above embodiments, the spark plug 100*e* preferably satisfies the relationship (4), The reason is as follows. The intrusion of unburnt gas into the clearance between the metal shell shelf 56*f* and the insulator trunk portion 14*b* is affected by the size of a clearance between the front end 56*t* of the metal shell shelf 56*f* and the insulator trunk portion 14*b*. Thus, when the spark plug 100*e* satisfies the relationship (4), as in the above-described embodiments, the intrusion of unburnt gas can be prevented. As a result, the fouling of the surface of the ceramic insulator is prevented. Therefore, the outer circumference of the insulator trunk portion 14*b* may be tapered towards the front end.

In addition, in the first to third embodiments, the radius of the outer circumference of the insulator trunk portion 14 is constant. In the first to third embodiments, the values of the radius r2 are the same in both cases where "r2" serves as the radius of the outer circumference of the portion, in the insulator trunk portion 14, which faces the front end of the metal shell shelf 56*f* and where "r2" serves as the radius of the outer circumference of the insulator trunk portion 14. That is, in the first to third embodiments, the radius r2 can be defined as the radius of the outer circumference of the portion, in the insulator trunk portions 14, which faces the front end of the metal shell shelf 56*f*.

Further, although it is not illustrated, the outer circumference of the insulator trunk portion may assume a shape that expands towards the front end. That is, the outer circumference of the insulator trunk portion may deform towards the front end. In addition, in the ceramic insulator, the insulator trunk portion may be defined as a portion having a face that faces the metal shell shelf 56*f*. Such face may be inclined within degrees with respect to the axis OD.

Figure 19:
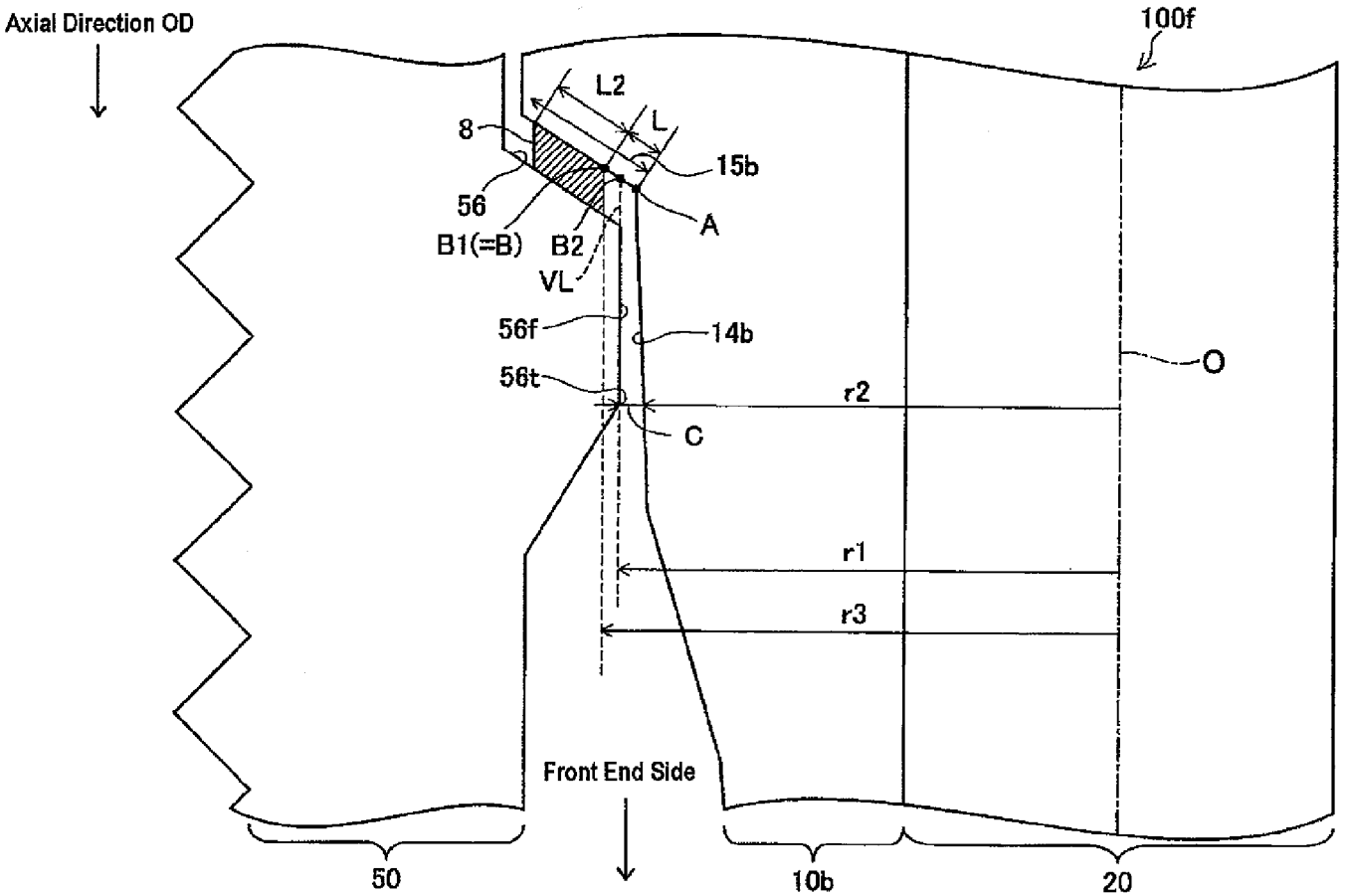
FIG. 19 is an enlarged view of a support portion 15 of a ceramic insulator 10 and its surrounding in a spark plug 100*f* according to a modification.

FIG. 19 is an enlarged view of the support portion 15 of the ceramic insulator 10 and its surrounding in a spark plug 100*f* according to a modification. The difference with respect to the second embodiment shown in FIG. 3 is that the outer circumference of the insulator trunk portion 14*b* is tapered towards the front end. Other composition of spark plug 100*f* is the same as that in the second embodiment. Further, the definition of the radius r2 is the same as that of the spark plug 100*e* shown in FIG. 18. Similar to the above embodiments, the spark plug 100*f* preferably satisfies the relationship (4).

Figure 20:
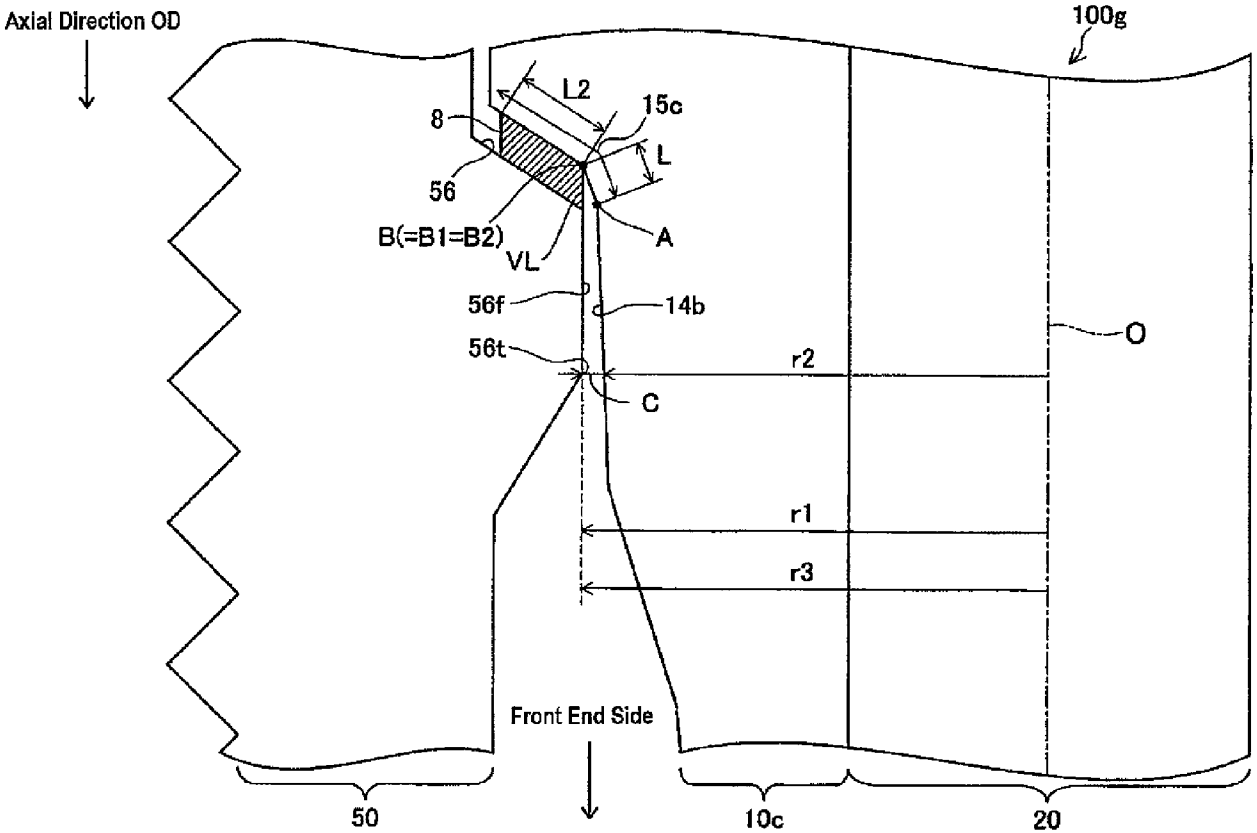
FIG. 20 is an enlarged view of a support portion 15 of a ceramic insulator 10 and its surrounding in a spark plug 100*g* according to a modification.

FIG. 20 is an enlarged view of the support portion 15 of the ceramic insulator 10 and its surrounding in a spark plug 100*g* according to a modification. The difference with respect to the second embodiment shown in FIG. 4 is that the outer circumference of the insulator trunk portion 14*b* is tapered towards the front end. Other composition of spark plug 100*g* is the same as that in the second embodiment. Further, the definition of the radius r2 is the same as that of the spark plug 100*e* shown in FIG. 18. Similar to the above embodiments, the spark plug 100*g* preferably satisfies the relationship (4).

DESCRIPTION OF REFERENCE NUMERALS

3: ceramic resistor
4: seal member
5: gasket
6: ring member
8: sheet packing
8*d*: sheet packing
9: talc
10: ceramic insulator
10*b*: ceramic insulator
10*c*: ceramic insulator
11: front end portion
12: axial bore
13: insulator nose
14: insulator trunk portion
15: support portion
15*b*: support portion
15*c*: support portion
15*r*: curving portion
17: front end side trunk portion
18: rear end side trunk portion
19: flange portion
20: center electrode
21: electrode base member
22: front end portion
25: core
30: ground electrode
32: proximal end portion
33: distal end portion
40: metal terminal
50: metal shell
51: tool engagement portion
52: mounting threaded portion
53: crimp portion
54: seal portion
55: seat surface
56: stepped portion
56*f*: metal shell shelf
56*t*: front end
57: front end portion
58: buckling portion
59: screw neck
90: center electrode tip
95: ground electrode tip
100: spark plug
100*b*: spark plug
100*c*: spark plug
100*d*: spark plug
200: engine head
201: mounting threaded hole
205: peripheral surface around the opening
G: spark discharging gap
O: axial line
L: creeping distance
R: radius of curvature
L2: contact length
OD: axial direction
CL: clearance
VL: virtual straight line Having described the invention, the following is claimed:

1. A spark plug comprising:

a rod-like center electrode;

an insulator assuming a generally cylindrical form and having therein a bore extending in an axial direction, the insulator accommodating the center electrode in a front end of the bore;

a metal shell assuming a generally cylindrical form, accommodating and holding therein the insulator with a stepped portion formed on an inner circumference of the metal shell for engaging with a support portion formed on an outer circumference of the insulator; and an annular packing fitted in an intervening manner between the support portion on the outer circumference of the insulator and the stepped portion on the inner circumference of the metal shell, wherein, in a cross-section including an axial line of the spark plug, the following relationship is satisfied:

$$0.6\ \text{mm} <= L,$$

where "A" represents a connection point between the support portion of the insulator and an insulator trunk portion formed at a front end side with respect to the support portion of the insulator, where "B" represents a position closer to the outer circumference side among positions of (a) an innermost position of a contact portion where the support portion of the insulator and the packing are in contact with each other and (b) an intersection of the support portion of the insulator and a virtual straight line that is parallel to the axial line and extends from an innermost circumferential end of the stepped portion of the metal shell, and where "L" represents a length of a path from the point "A" to the point "B" along a surface of the insulator; and wherein the following relationship is satisfied:

$$r1 - r2 <= 0.5\ \text{mm}$$

where "r1" represents a radius of an inner circumference of a metal shell shelf positioned frontwards with respect to the stepped portion of the metal shell, and where "r2" represents a radius of an outer circumference of a portion that faces a front end of the metal shell shelf in the insulator trunk portion.

2. The spark plug according to claim 1, wherein the support portion of the insulator includes a curving portion at a front end side thereof through which the support portion is connected to the insulator trunk portion, and the following relationship is satisfied:

$$0.6\ \text{mm} <= R <= 1.5\ \text{mm},$$

where "R" represents a radius of curvature of the curving portion.

3. The spark plug according to claim 1, wherein the point B1, which is located in the innermost position of the contact portion where the support portion of the insulator and the packing are in contact with each other, is positioned outward with respect to the virtual straight line, and the following relationship is satisfied:

$$0.3\ \text{mm} <= L2,$$

where, in the cross-section including the axial line, "L2" represents a length of one of two contact surfaces where the support portion of the insulator and the packing are in contact with each other.

4. The spark plug according to claim 1, wherein the following relationship is satisfied:

$L <= 0.9$ mm.

5. The spark plug according to claim 1, wherein a mounting threaded portion on an outer circumferential face of the metal shell for mounting the spark plug on a fitting member has a thread size of M12 or less.

* * * * *